US009309036B2

(12) United States Patent
Steele et al.

(10) Patent No.: US 9,309,036 B2
(45) Date of Patent: Apr. 12, 2016

(54) PACKAGE WITH ENCLOSED UTENSIL

(71) Applicant: Mark Steele, New Prague, MN (US)

(72) Inventors: Mark Steele, New Prague, MN (US); Greg Melchoir, Green Bay, WI (US)

(73) Assignee: Mark Steele, New Prague, MN (US)

( * ) Notice: Subject to any disclaimer, the term of this patent is extended or adjusted under 35 U.S.C. 154(b) by 0 days.

(21) Appl. No.: 14/063,901

(22) Filed: Oct. 25, 2013

(65) Prior Publication Data

US 2014/0120207 A1 May 1, 2014

Related U.S. Application Data

(60) Provisional application No. 61/718,444, filed on Oct. 25, 2012, provisional application No. 61/726,543, filed on Nov. 14, 2012.

(51) Int. Cl.

| | |
|---|---|
| ***B65D 77/24*** | (2006.01) |
| ***A47G 21/12*** | (2006.01) |
| *B65D 75/00* | (2006.01) |
| *B65D 75/58* | (2006.01) |
| *B65D 33/25* | (2006.01) |

(52) U.S. Cl.

CPC ..... *B65D 77/245* (2013.01); *A47G 21/12* (2013.01); *B65D 33/2508* (2013.01); *B65D 75/008* (2013.01); *B65D 75/5805* (2013.01)

(58) Field of Classification Search

CPC .... A47G 21/12; B65D 77/245; B65D 75/008; B65D 75/5805; B65D 33/2508; B65D 31/12; B65D 81/3261; B65D 33/2566

USPC ..... 206/37–39, 380, 484, 484.2, 524.8, 206/541, 542, 548, 549, 466; 383/9, 22, 23, 383/40, 63, 210, 4, 107, 902; 426/112, 115, 426/119, 120, 124, 132

See application file for complete search history.

(56) References Cited

U.S. PATENT DOCUMENTS

| | | | | |
|---|---|---|---|---|
| 3,730,337 | A * | 5/1973 | White | 206/484 |
| 4,138,014 | A * | 2/1979 | Bouman | 206/542 |
| 4,930,637 | A | 6/1990 | DeRoseau | |
| 5,586,931 | A * | 12/1996 | Williams, Jr. | 30/120.1 |
| 6,053,635 | A | 4/2000 | Anderson et al. | |
| 6,116,420 | A * | 9/2000 | Hall et al. | 206/380 |
| 6,126,317 | A | 10/2000 | Anderson et al. | |
| 6,254,907 | B1 | 7/2001 | Galomb | |
| 6,533,711 | B1 | 3/2003 | Anderson et al. | |
| 6,719,140 | B1 | 4/2004 | Rinsler | |
| 7,207,717 | B2 | 4/2007 | Steele | |
| D549,594 | S | 8/2007 | Steele | |
| D621,280 | S | 8/2010 | Steele | |
| 7,883,268 | B2 | 2/2011 | Steele | |
| 2002/0066738 | A1 | 6/2002 | Agarwal et al. | |
| 2003/0138169 | A1* | 7/2003 | Bell | 383/7 |
| 2003/0210838 | A1 | 11/2003 | Steele | |
| 2004/0031244 | A1 | 2/2004 | Steele | |
| 2004/0120613 | A1* | 6/2004 | Hanson | 383/63 |
| 2005/0069227 | A1 | 3/2005 | Steele | |
| 2006/0113212 | A1 | 6/2006 | Steele | |
| 2006/0126970 | A1* | 6/2006 | Perell | 383/210 |

(Continued)

*Primary Examiner* — Luan K Bui

(74) *Attorney, Agent, or Firm* — Skaar Ulbrich Macari, P.A.

(57) ABSTRACT

A package having a toothpick or other utensil that is defined or protectable within an interior sterile and/or sanitary area of the package that will not be confused with consumable contents. Multiple utensils can be provided of the same or different types.

17 Claims, 5 Drawing Sheets

(56) References Cited

U.S. PATENT DOCUMENTS

| | | | | |
|---|---|---|---|---|
| 2006/0215942 | A1 | 9/2006 | Steele | |
| 2007/0189641 | A1 | 8/2007 | Steele | |
| 2008/0002918 | A1 | 1/2008 | Steele | |
| 2008/0107781 | A1 * | 5/2008 | Carroll | 383/40 |
| 2008/0149524 | A1 | 6/2008 | Rademaker | |
| 2008/0279485 | A1 | 11/2008 | Steele | |
| 2008/0296310 | A1 | 12/2008 | Steele, IV et al. | |
| 2009/0107866 | A1 | 4/2009 | Dunn-Rankin | |
| 2009/0180716 | A1 | 7/2009 | Steele | |
| 2009/0208147 | A1 | 8/2009 | Steele | |
| 2009/0238499 | A1 | 9/2009 | Steele | |
| 2009/0245699 | A1 | 10/2009 | Steele | |
| 2009/0277916 | A1 | 11/2009 | Steele | |
| 2010/0012531 | A1 | 1/2010 | Steele | |
| 2010/0226600 | A1 | 9/2010 | Steele | |
| 2011/0042407 | A1 | 2/2011 | Steele | |
| 2011/0103714 | A1 | 5/2011 | Steele et al. | |
| 2011/0182531 | A1 | 7/2011 | Steele | |
| 2011/0253728 | A1 | 10/2011 | Steele | |
| 2012/0006702 | A1 | 1/2012 | Steele | |
| 2012/0074002 | A1 | 3/2012 | Steele et al. | |
| 2012/0196730 | A1 | 8/2012 | Steele et al. | |
| 2013/0037563 | A1 | 2/2013 | Steele et al. | |
| 2014/0245698 | A1 | 9/2014 | Steele | |

* cited by examiner

PACKAGE WITH ENCLOSED UTENSIL

PRIORITY

This application claims priority to and the benefit of U.S. Provisional Application Ser. No. 61/718,444, filed on Oct. 25, 2012, and priority to and the benefit of U.S. Provisional Application Ser. No. 61/726,543, filed on Nov. 14, 2012, both of which are hereby incorporated herein by reference in their entirety.

FIELD

The present invention relates generally to flexible packaging and, more particularly, to packages, and methods for forming and using packages, having toothpicks or other utensils provided to the package.

BACKGROUND

Flexible packages are used for containing and dispensing a wide variety of items, both solid and liquid, such as food products. Flexible packages are particularly well suited to contain and dispense easily portable food products, for example beef jerky. However, jerky and many other food products can become lodged between the consumer's teeth during consumption. It would be beneficial for the consumer to have a readily available toothpick to help dislodge the particles.

Although the manufacturer of the product, or the packaging company, could possibly provide toothpicks by packing them with the food products, it would be expensive and would require special attention so the consumer would not accidentally ingest the toothpick. There is no safeguard for this, as there is little or no ability to control how a consumer eats the product. If the consumer does not pay attention when eating the product, they could ingest the toothpick packaged there within despite any warnings on the package.

Similarly, there is often a need to provide the user with a utensil, such as a spoon, straw, knife, fork, chopsticks, etc. for consuming the food in the package. Including such functional utensils in the package presents many of the same difficulties as explained above with regard to the toothpick.

Therefore there is an unmet need to safely provide a flexible package, and methods for forming and using packages, having toothpicks or other utensils provided to the package.

SUMMARY

The present invention addresses certain problems facing flexible packages and the packaging industry. Embodiments of the present invention are directed to a flexible package having a toothpick or other utensil defined or provided therein. In certain embodiments, the toothpick is defined or protectable within an interior sterile and/or sanitary area of the package that will not be confused with consumable contents. The package can be provided in a variety of ways and configurations as will be shown and/or described herein and equivalents thereof.

In one example embodiment, a toothpick (or other utensil) is die-cut or scored within the seals or other portions of the packaging material where the consumer could punch, tear, or otherwise dislodge the utensil from the packaging material as needed for use. This function would require a separate step from consuming the product, so the opportunity for the consumer to mistakenly ingest the toothpick or utensil is almost nonexistent. The cost of the method and apparatus of certain embodiments method would also be much less expensive than other options, since the toothpick or utensil is actually formed from a portion of the package that would typically need to be present anyway.

In one example embodiment, the shapes of toothpicks or utensil would be in a section of the package that will not affect the function of the package to keep the product fresh. A preferred location would be within one or more of the seals of the package, where only a portion of the seal would be used, leaving enough of the seal remaining to maintain the integrity of the package once the toothpick was removed. Further, either of the seals running in machine direction of the package can be provided with a reinforcement of material added during the package formation, which would make the portion to be used for a toothpick stronger and/or stiffer than the remainder of the package. This would allow the toothpick or utensil to function better without substantially raising the cost of the entire package. Reinforcement could be added to any section of the package.

The top header seal is typically removed in certain embodiments when the consumer wishes to gain access to the product within the package. The header seal is typically discarded by the consumer. In other embodiments, a re-closeable device can be provided for products where the package will be used multiple times. For example, a front panel zipper such as that disclosed in US Patent Publication No. 2012/0046151 could be used. Said US Patent Publication is hereby incorporated herein by reference in its entirety. With this style of zipper, both halves of the zipper flange are sealed to one side of the package. The consumer gains access into the package by separating the two sections of the zipper through this one panel of the package. Therefore, the header seal area is not removed from the package and the toothpicks contained within the header seal will be there for multiple uses. Each time the consumer eats product from the package, they could dislodge another toothpick from the header area.

Other functional utensils could also me made in this way. For instance, small spatulas for spreading icing or cheese could be incorporated in the same way. Little funnels or spouts can be provided within the package and removed to help direct the pouring of the product within. Chopsticks, knives and other common eating utensils (including combinations of multiple utensils) can also be provided according to various embodiments.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
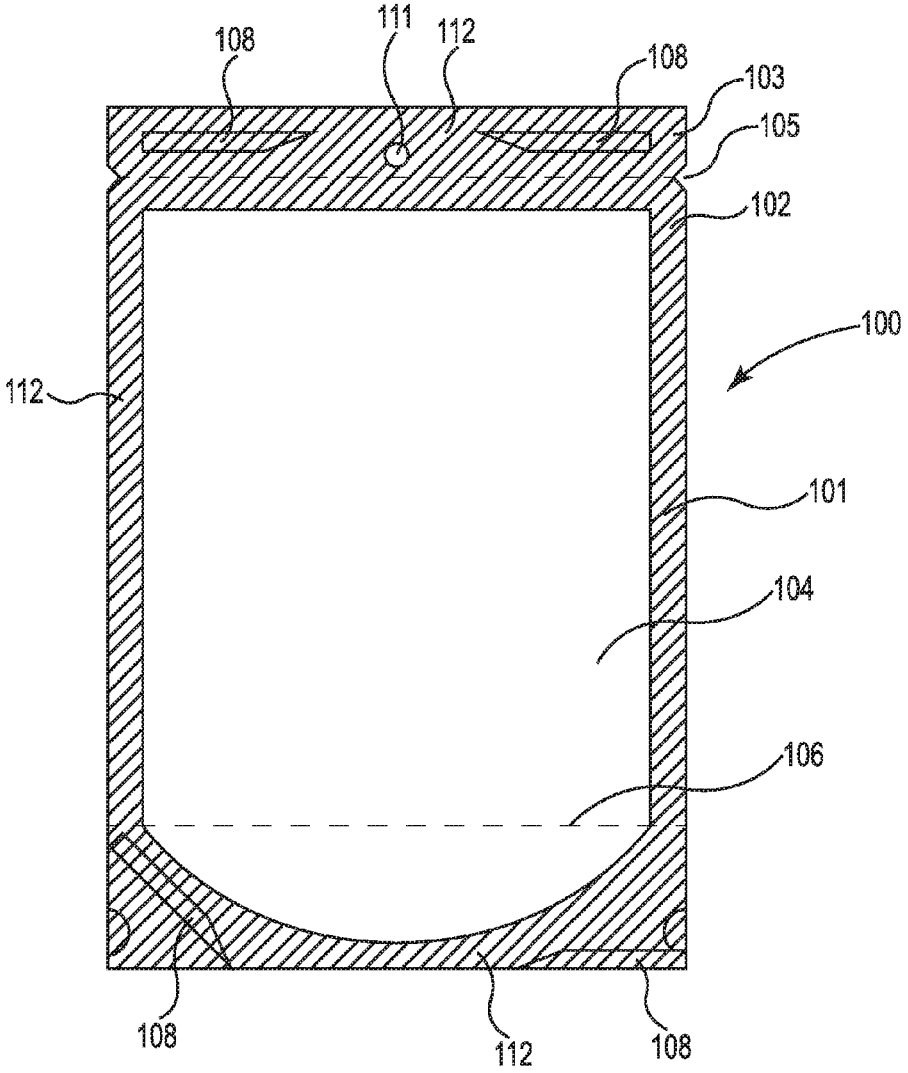
FIG. 1 is a front view of a package in accordance with an example embodiment of the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims. For illustrative purposes, cross-hatching, dashing or shading in the figures is provided to demonstrate sealed portions and/or integrated regions or devices for the package.

DETAILED DESCRIPTION

In the following descriptions, the present invention will be explained with reference to example embodiments thereof. However, these example embodiments are not intended to limit the present invention to any specific example, embodiment, environment, applications or particular implementations described in these embodiments. Therefore, description of these example embodiments are only for purpose of illustration rather than to limit the present invention.

It should be appreciated that, in the following embodiments and the attached drawings, elements unrelated to the present invention are omitted from depiction; and dimensional relationships among individual elements in the attached drawings are illustrated only for ease of understanding, but not to limit the actual scale. For illustrative purposes, hatching or shading in the figures is generally provided to demonstrate sealed or crushed portions and/or integrated devices for the package.

References to "top," "bottom," "front," "back" and the like are for illustrative purposes only and are not meant to limit the scope of the disclosed invention. For instance, placing an access device on the "front" panel could be just as easily employed in the back or side portions of the package.

Referring to FIGS. 1-5, the package 100 comprises a sanitary pouch 101 that can be used in non-sanitary areas which could have made contact with many types of germs or other contaminants during the shipping and storing process. The inside of the pouch 101 will remain sanitary during this time. The flexible package 100 comprises a front panel 102 and an opposing back panel defining an interior compartment 104 accessible via a frangible portion 103 of the package or through a re-sealable closure. Tear notches 105 can be provided to aid in removing frangible portion 103. The edges of the front 102 and back panels are sealed together. However, one or more of the portions of the package 100 may be gusseted. Placing a gusset 106 on the bottom also provides the product with the ability to stand up on its own. Other panels, such as a side panel, can be gusseted as well.

Figure 2:
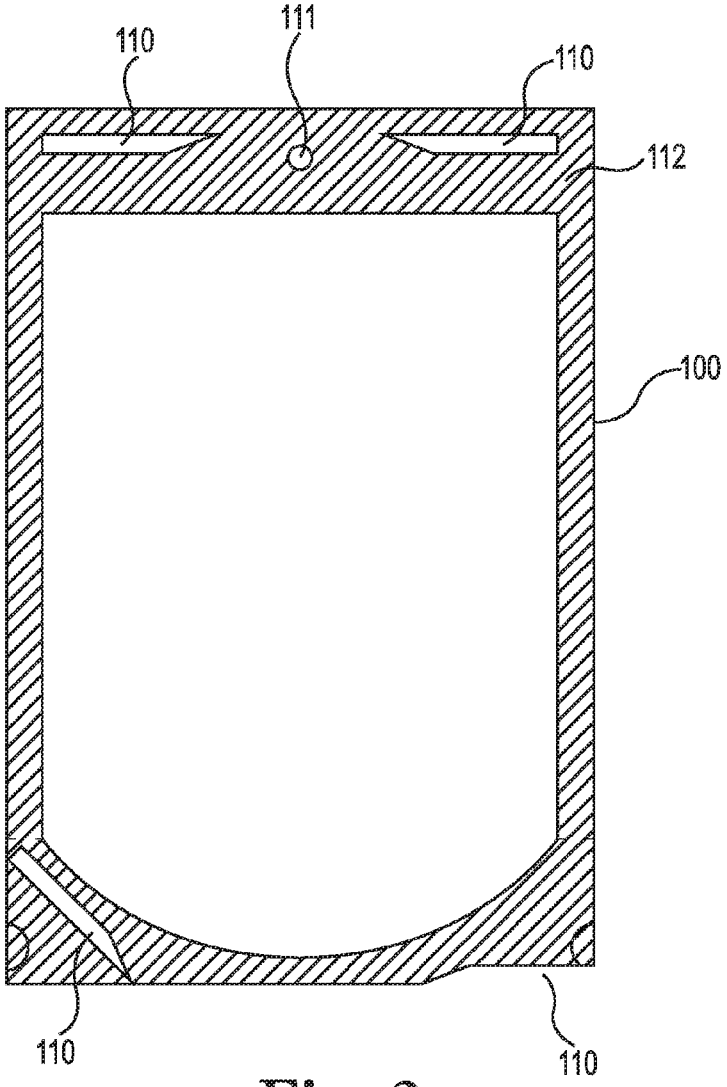
FIG. 2 is a front view of the package of FIG. 1 with the utensils removed.
Figures 3, 3A:
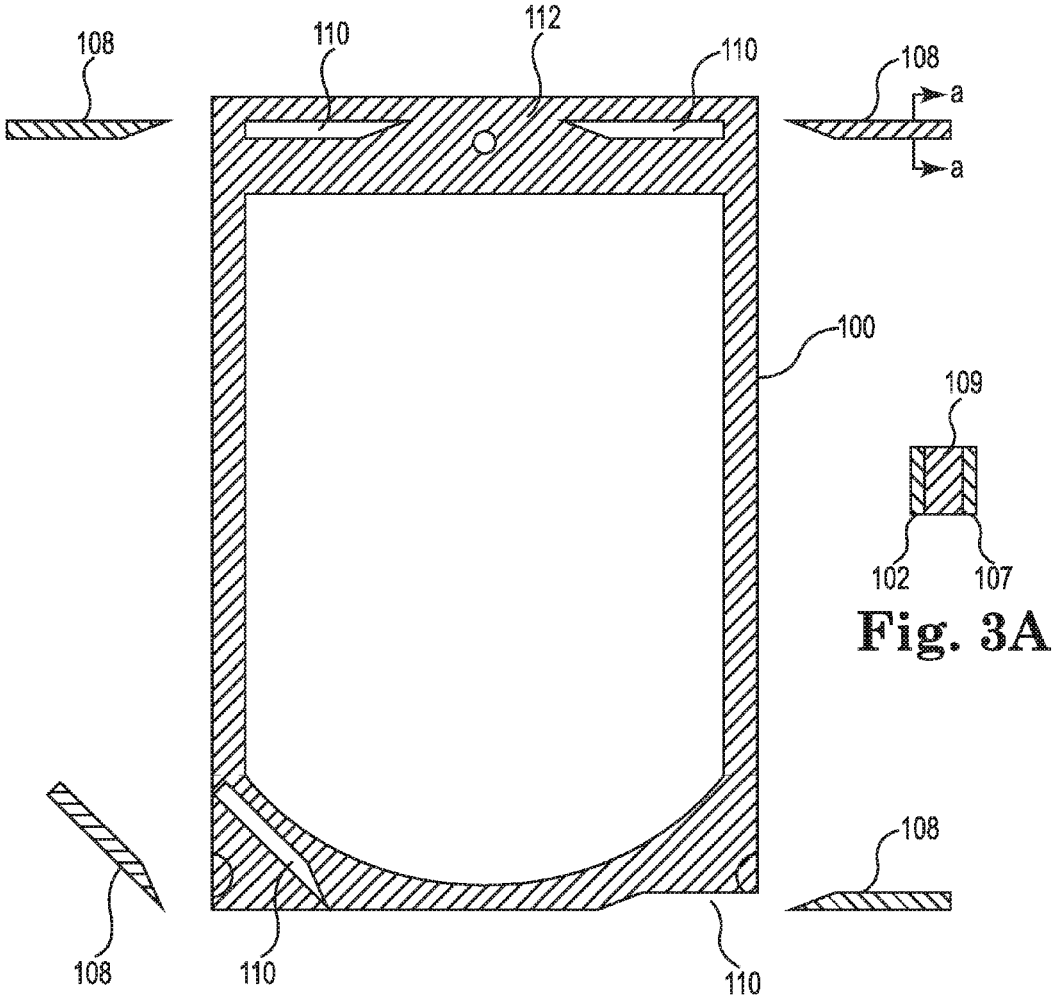
FIG. 3 is a front view of a package in accordance with an example embodiment of the present invention showing relative placement of utensils as removed from the package.
FIG. 3A is an end cross-sectional view of the utensil of FIG. 3 taken along line a-a in accordance with an example embodiment of the present invention.
Figure 4:
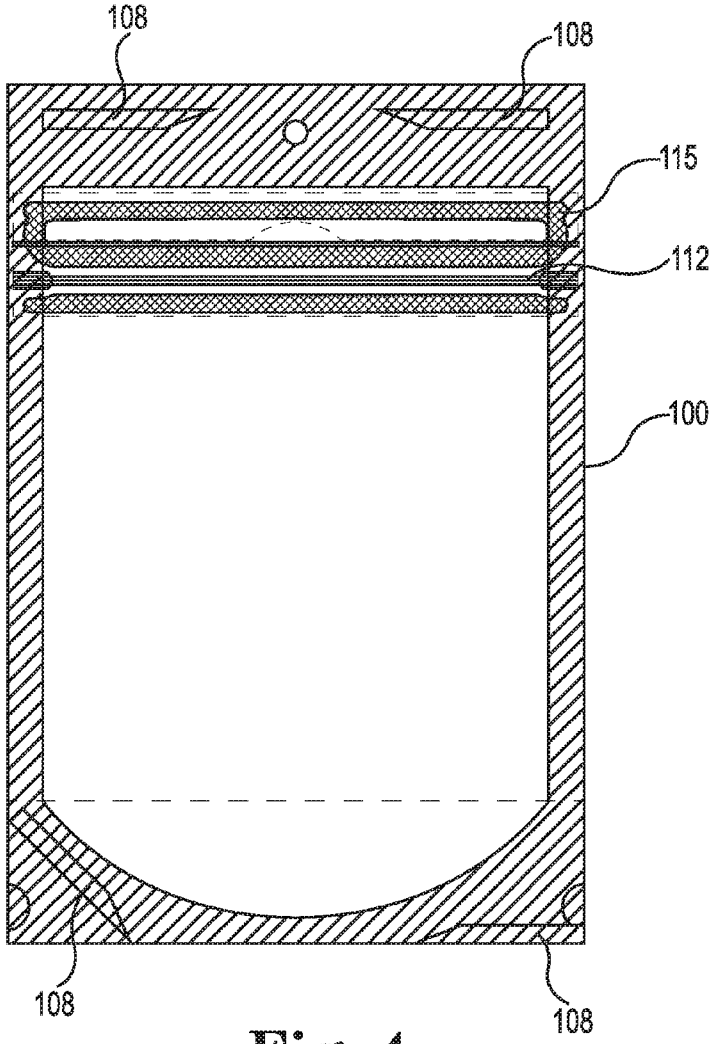
FIG. 4 is a front view of a package using a front panel zipper device in accordance with another example embodiment of the present invention.

Referring to FIG. 1, a plurality of utensils 108, such as toothpicks, are shown being defined in the sealed portions of the package 100. A merchandising aperture 111 can be provided to a top frangible 103 sealed portion of the package 100 to facilitate hanging on a display peg. FIGS. 2 and 3 show the utensils 108 removed from the package and leaving spaces 110 behind where the utensils once resided. In one embodiment, the utensil 108 comprises a defined portion of the front and back panels. The utensil is defined, such as by stamping, during the package manufacturing process.

Referring to FIG. 3A, in an alternative embodiment, a film layer 109 serves as the material forming the utensil. Film layer 109 is disposed between the front 102 and back 107 panels during the manufacturing process. The film layer 109 can be thicker and/or stiffer than the material forming the front and back panels. In use, when the utensil is removed from the package, the user unwraps or removes the layers 102 and/or 107 to expose the utensil. In certain embodiments one of the front 102 or back panel 107 can be removed from the package with utensil layer 109. In other embodiments, both layers 102 and 107 are removable. In a further embodiment, the center film 109 can be exposed by peeling one of the front 102 and back 107 panel films partially away from the package to expose the utensil for removal.

The utensils in the above-described embodiments are preferably die-cut into the sealed portion 112 of the package where two panels, or a panel and gusset, come together. Laser etching, scoring, stamping, pressing, die cutting, or other suitable processes can also be used to define the utensil 108. The utensil can be located wholly or partially in various portions of the packaged region as shown in FIGS. 1-3A. Also, multiple utensils 108 can be defined in the same package. The utensils can be the same or there can be a mix of different utensils. For example, there can be included a toothpick and a knife. Other combinations of common implements are within the scope of the invention, including spatulas, chopsticks, forks, straws, spoons, spouts, toy characters, figurines, and the like.

The utensil can be located in any portion of the package. For example, in a package with a recloseable device such as a zipper 113, shown in FIG. 4, the upper flange 115 of the zipper 113 (or other portion thereof) can be used as the reinforcement material for the toothpick or utensil, so an additional material is not necessary. The utensil can also be provided to other reinforced portions, such as handle portions. Other locations such as seals and labels provided to the package can also be used to contain the utensil without departing from the scope of the invention.

In use, the consumer presses on an end portion of the utensil 108 with sufficient pressure to break the attachment of the utensil with the surrounding package material, thereby dislodging the utensil. Keeping the utensil separate from the contents of the package ensures that the user does not accidentally ingest it. The utensils can be colored and/or textured and/or labeled differently than the surrounding package to highlight their presence.

Referring again to FIG. 4, the package 100 is provided with a re-closable seal 113, such as single panel zipper, as shown where the consumer can open the package 100 without removing the seal 115 above the zipper with includes utensils 108. The utensils 108 are as previously described with regard to FIGS. 1-3A. The zipper 113 allows the user to re-seal the package 100 after consuming some of the contents so that the remaining contents can be safely contained, freshness maintained and contamination prevented.

Figure 5:
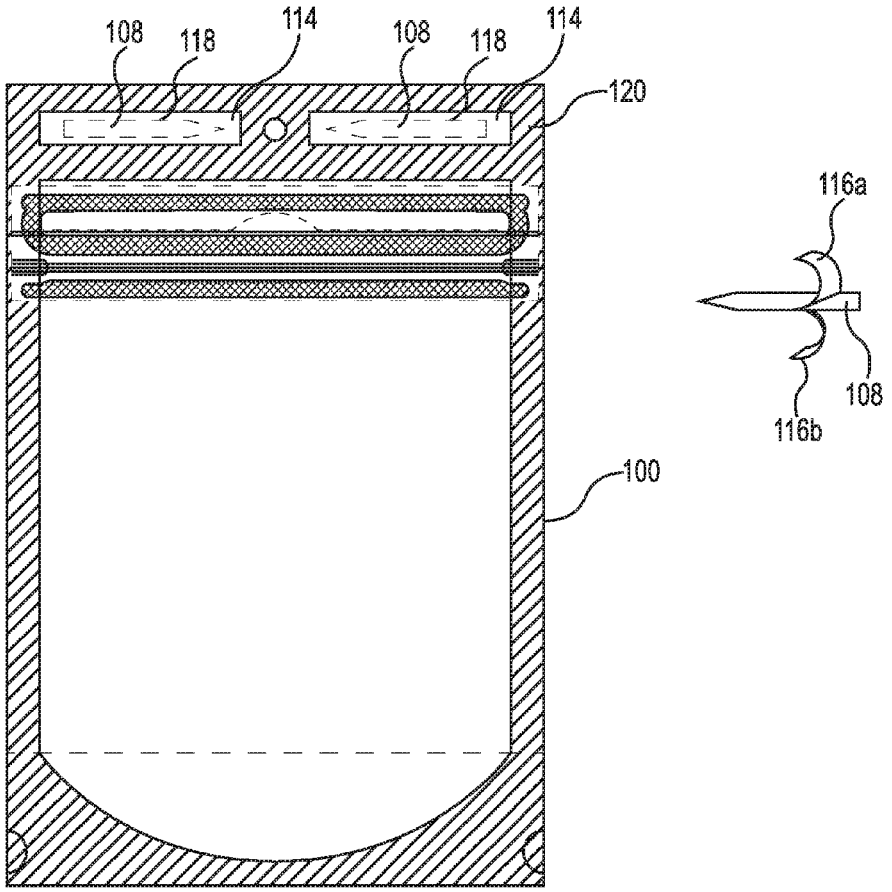
FIG. 5 is a front view of a package showing removal of a utensil and the utensil being unwrapped, in accordance with an example embodiment of the present invention.

Referring to FIG. 5, an embodiment with a sanitary utensil configuration is shown. The package 100 sealed portions define one or more utensil pockets 114 therein. The pockets 114 completely seal the utensil 108 therein so that the utensil is not exposed to environmental or other contaminants.

In a further aspect as shown in FIG. 5, the utensil 108 (here a toothpick) can be sealed in a film 116*a* and 116*b* or other wrapper to ensure the sterility of the utensil. The film-sealed utensil can be placed in the pocket 114. The non-cross-hatched portion indicating the pocket 114 is a non-sealed area between two sealed panels (e.g., front and rear panels). The sealed utensil 108 can be unwrapped by peeling back the front and back (or top and bottom) wrapper layers 116*a* and 116*b* after the utensil 108 is punched out of the pocket 114 by the user.

In another embodiment, the dashed line 118 indicated in FIG. 5 indicates the profile of the toothpick 108 that is mostly cut out so the consumer only needs to push their finger or thumb through that area and the toothpick 108 will punch out. Then, for a sanitary toothpick like in this particular description, since this area was not sealed, the user can peel the front and back panels of the pouch material 116*a* and 116*b* away from the center, stiffer, film and use it for the toothpick. Further, a film material can be provided to cover the pocket 114 such that peeling away of the material exposes the utensil 108 within the pocket 114. The utensil 108 can then be forced out of the pocket as described herein for use.

In yet another embodiment, the header seal area of the package 120 can be configured with a separate, more rigid material, placed between the front and back panels of the package where the entire area would be sealed except the die cut areas, and/or a region surrounding those areas, where the utensil 108 would be ejected from. This way, the consumer can punch out the die cut area, and then peel the front and back packaging material away from the inner material defining the utensil, leaving just the sanitary inner material to be used as the utensil.

The pockets 114 and utensils 108 can be placed in any location in the sealed regions between two panels or panel/gusset portions.

The package can also be provided with a mixture of the utensils formed according to the various embodiments described herein.

The package according to the invention can include packages constructed, in whole or in part, of flexible, rigid, semi-rigid, or semi-flexible materials or panels, or clamshell (e.g., thermoformed trays) packages. The construction of packages is generally described in U.S. Patent Publication Nos. 2013/0037563, 2012/0006702, 2011/0182531, 2011/0042407 and 2003/0210838, all of which are hereby incorporated by reference in their entirety. Briefly, the package panel portions are generally constructed of flexible sheet material such as polyethylene, polyester, metal foil, polypropylene, or polyethylenes or polypropylenes laminated with other materials such as nylon, polyester, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The present invention in certain embodiments permits the flexible package to be made using less expensive or cheaper materials than would otherwise be necessary.

The package 100 and its portions can be formed to provide a stand-up pouch, pre-made pouch, bag-top, one formed and filled on a "form-fill-seal" (e.g., vertical, horizontal, etc.) machine, thermoforming machine, and other known package designs and configurations. Other known package designs and packaging techniques and features can be adapted to incorporate or form the configuration of the present invention as well. The utensil 108 can be provided to the package 100 during the machining or formation process, or pre-applied to a section of material or web prior to package formation.

Embodiments employing seals can utilize heat seals, adhesive bonding, and various other known sealing techniques. Further, various tearable or removable portions of seals or package portions can include notches, scoring, perforations or the like to facilitate removal.

Various figures and descriptions disclose certain features and accessories. However, it must be noted that these features are merely illustrative in nature and may be placed in varying locations and under varying configurations and shapes, and still be consistent with the present invention. Various regions of the package can include a handle portion, access devices (e.g., re-closeable zipper devices), and the like. In addition, the shape and configuration for the panel portions are also merely illustrative and can be altered without deviating from the spirit and scope of the present invention. Any of the panel portions, or selected regions thereof, can include various aesthetic and functional graphics, such as logos, instructions, advertising, bar codes, and the like. These graphics can run transverse, parallel, or even in a diagonal orientation to the longitudinal panel edges discussed herein.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive package 100.

What is claimed is:

1. A flexible package, comprising:

a first panel;

a second panel sealed to the first panel, defining an open interior compartment therebetween and a sealed portion therebetween; and a first utensil formed at the sealed portion such that the utensil is constructed at least in part by a portion of the first panel or the second panel.

2. The flexible package of claim 1, wherein the sealed portion comprises a frangible portion adjacent a top edge of the package, wherein the first utensil is disposed within the frangible portion, and wherein removal of the frangible portion creates an access opening to the open interior compartment.

3. The flexible package of claim 2, wherein the sealed portion includes a tear notch to facilitate removal of the frangible portion.

4. The flexible package of claim 1, wherein the first utensil is further sealed within a wrapper.

5. The flexible package of claim 1, further comprising a second utensil.

6. The flexible package of claim 5, wherein the second utensil is of a different type than the first utensil.

7. The flexible package of claim 1, wherein the first utensil is a toothpick.

8. The flexible package of claim 1, further comprising a re-closeable device located in the sealed portion such that the re-closeable device can re-seal the open interior compartment after a portion of the sealed portion is removed.

9. The flexible package of claim 1, wherein a utensil pocket is defined in the sealed portion and the first utensil is disposed fully within the utensil pocket.

10. The flexible package of claim 1, further comprising a gusset disposed between a portion of the first panel and the second panel.

11. A flexible package, comprising:

a first panel;

a second panel sealed to the first panel defining an interior compartment therebetween and a sealed portion therebetween; and a first utensil stamped from a portion of the sealed portion such that the utensil includes at least a portion of the first panel and does not communicate with the interior compartment.

12. The flexible package of claim 11, further comprising a zipper provided to a portion of the sealed portion, the first utensil being defined in an upper flange of the zipper.

13. The flexible package of claim 11, further comprising a reinforcement material disposed between the first and second panels in at least a portion of the sealed portion.

14. The flexible package of claim 11, further comprising a re-closeable device located in the sealed portion such that the re-closeable device can re-seal the interior compartment after a portion of the sealed portion is removed.

15. The flexible package of claim 11, wherein the first utensil is located in a section of the sealed portion that is not removed when a user accesses the contents of the package.

16. The flexible package of claim 11, further comprising a second utensil.

17. The flexible package of claim 16, wherein the second utensil is of a different type than the first utensil.

* * * * *